US006637347B1

(12) United States Patent
Richard et al.

(10) Patent No.: US 6,637,347 B1
(45) Date of Patent: Oct. 28, 2003

(54) ANTI-SPIN/ANTI-DRIFT MODULE FOR RAILWAY CAR DOOR

(75) Inventors: Barry M. Richard, Omaha, NE (US); Kenneth R. Graham, Omaha, NE (US); Roger W. Hike, Omaha, NE (US)

(73) Assignee: Chief Industries, Inc., Grand Island, NE (US)

( * ) Notice: Subject to any disclaimer, the term of this patent is extended or adjusted under 35 U.S.C. 154(b) by 0 days.

(21) Appl. No.: 10/251,591

(22) Filed: Sep. 20, 2002

(51) Int. Cl.[7] ..... B61D 17/00
(52) U.S. Cl. ..... 105/378; 49/220
(58) Field of Search ..... 105/286, 378; 49/218, 219, 220; 292/39, 40

(56) References Cited

U.S. PATENT DOCUMENTS

| | | | | |
|---|---|---|---|---|
| 3,413,758 A | * 12/1968 | Palsson | 49/220 |
| 3,555,731 A | 1/1971 | Ross, Jr. | 49/210 |
| 3,660,938 A | 5/1972 | Ross, Jr. et al. | 49/220 |
| 3,776,581 A | 12/1973 | Ross, Jr. | 292/39 |
| 3,786,599 A | 1/1974 | Galbarzyk et al. | 49/220 |
| 3,913,269 A | 10/1975 | Ross, Jr. | 49/220 |
| 3,923,327 A | 12/1975 | Ross, Jr. | 292/39 |
| 4,064,810 A | 12/1977 | Jenkins | 105/378 |
| 4,112,540 A | 9/1978 | Wright et al. | 16/99 |
| 4,162,591 A | 7/1979 | Madland et al. | 49/277 |
| 4,240,357 A | 12/1980 | Phillips | 105/378 |
| 4,344,366 A | 8/1982 | Madland | 105/378 |
| 4,390,196 A | 6/1983 | Madland | 292/66 |
| 4,429,921 A | 2/1984 | Fritz et al. | 308/3.5 |
| 4,683,678 A | 8/1987 | Cummings et al. | 49/426 |
| 4,751,793 A | 6/1988 | Jenkins et al. | 49/501 |
| 4,920,894 A | 5/1990 | Thoman | 105/378 |
| 6,546,611 B1 * | 4/2003 | Ryan | 105/378 |

* cited by examiner

*Primary Examiner*—S. Joseph Morano
*Assistant Examiner*—Lars A. Olson
(74) *Attorney, Agent, or Firm*—Thomte, Mazour & Niebergall; Dennis L. Thomte

(57) ABSTRACT

A module is provided for use with a drive mechanism particularly suited for plug-type railcar doors to prevent "overspinning" and "drifting." The mechanism disclosed is a double brake-type mechanism and includes a first rotatably mounted member. The first member is arranged to transmit force in either direction of rotation and is connected with an input drive mechanism. The drive mechanism includes a rotatable pinion gear carried on a rotatable input shaft extending generally parallel to the axis of rotation of the first member. The pinion gear is connected with the shaft by means which cause it to move longitudinally of the shaft to a first or a second spaced point depending upon the direction the shaft is rotated. At each of the points, there are ratchets which are freely rotatable relative to the shaft except when the pinion gear moves to engage them at their respective points. When engaged, the ratchets permit movement of the shaft only in one direction. The arrangement is such that should the driven mechanism being moving the member at a rate greater than the pinion, the pinion will move longitudinally of the shaft to engage the other ratchet wheel and prevent movement of the shaft in response to force input from the driven mechanism. One of the ratchets has an even number of teeth and one of the ratchets has an odd number of teeth. The profiles of the ratchet teeth on the ratchets are different.

6 Claims, 9 Drawing Sheets

ANTI-SPIN/ANTI-DRIFT MODULE FOR RAILWAY CAR DOOR

BACKGROUND OF THE INVENTION

1. Field of the Invention

This invention relates to an anti-spin/anti-drift module for use with a "plug-in" or "plug-type" railway car door and more particularly to an anti-spin/anti-drift module including first and second ratchets wherein the first ratchet has an odd number of ratchet teeth and the second ratchet has an even number of ratchet teeth.

2. Description of the Prior Art

Compression-sealing "plug-in" or "plug-type" doors are commonly provided for railway freight cars where an ambient sealing of the interior is desired, a typical case in point being refrigerated railway cars. Such doors often have a gear-operated door frame engaging mechanism coupled to be driven by rotation of a handle affixed to a pinion shaft which operates the mechanism to alternatively sealingly close the door, or alternatively to unlock it. These mechanisms are inherently powerful, and when the door is compressingly sealed, a significant reverse torque is imparted to the handle as a result of the compression forces. Such a reverse torque can also arise from a number of other factors, such as a shifted load of product inside the car leaning against the door, or the force of the door's own weight when the car is tilted to lean outward. Handles are routinely secured against counter-rotation in the door-opening direction by handle locking mechanisms of one sort or another. To open the door, however, the handle lock must be released. If, at that time, or at any other time during rotation of the handle in the door-opening direction, the operator should lose control of the handle, the handle will frequently spin, resulting in a highly dangerous condition to the operator, and occasionally resulting in broken bones.

An anti-spin device for use with "plug-in" or "plug-type" railcar doors is described in U.S. Pat. No. 4,920,894, a patent owned by the assignee of this invention. U.S. Pat. No. 3,660,938 discloses a dual brake-type drive mechanism which is an anti-spin/anti-drift type of mechanism. The anti-spin/anti-drift mechanism disclosed in U.S. Pat. No. 3,660,938 includes first and second ratchets having the same number of ratchet teeth provided on the outer peripheries thereof. First and second gravity-operated ratchet pawls are in engagement with the ratchet teeth on the first and second ratchets, respectively. When the unit of the '938 patent is installed in a plug-in door, the mechanism of the '938 patent provides an anti-spin function to prevent handle backspin when opening the door and an anti-drift function to prevent the door from drifting into the car once the door is open. However, with the door of the '938 patent in the open position, as the operator begins to close the door against the gasket seal, if the operator releases the handle when the ratchet pawl is disengaged from the anti-spin ratchet, the handle may violently spin like a propeller. This occurs if the ratchet pawl is on top of the ratchet tooth instead of being engaged into the tooth of the anti-spin ratchet.

SUMMARY OF THE INVENTION

An anti-spin/anti-drift module is described for attachment to a railway car plug-in door locking mechanism which releasably locks the door. The module comprises a pinion shaft with the outer end thereof extending through the outer surface of the railway car door. An operating handle is attachable to the outer end of the pinion shaft for operating the same. A back plate is secured to inner end of the pinion shaft and has at least a pair of spaced-apart arcuate slots formed therein. The pinion shaft is provided with an externally threaded portion thereon outwardly of the back plate. A pinion shaft sleeve is threadably mounted on an externally threaded portion of the pinion shaft. A pinion gear assembly is mounted on the pinion shaft sleeve for rotation therewith and includes an outer ring-shaped plate at its outer end and an inner ring-shaped plate at its inner end. The pinion gear assembly includes an externally presented pinion gear positioned between the inner and outer plates. The pinion gear assembly includes inwardly extending dogs which are movably received by the arcuate slots in the back plate. A first ring-shaped ratchet, ratchet wheel or ratchet gear is rotatably positioned between the inner ring-shaped plate and the back plate and includes a plurality of spaced-apart ratchet teeth. Friction pads or discs are positioned on the opposite sides of the first ratchet. A second ring-shaped ratchet, ratchet wheel or ratchet gear is rotatably positioned adjacent the outer surface of the outer ring-shaped plate with the second ratchet including spaced-apart ratchet teeth. First and second ratchet pawls are in engagement with the ratchet teeth of the first and second ratchets, respectively. Friction pads or discs are positioned on opposite sides of the second ratchet. A flange is mounted on the pinion shaft for rotation therewith outwardly of the second ratchet. The ratchet teeth of the first and second ratchets face opposite directions and have different profiles. The first ratchet has an even number of ratchet teeth (20) while the second ratchet has an odd number of ratchet teeth (21). With the module of this invention, it is impossible for the handle to violently spin as described above when the car door is open and the operator begins to close the same. The uneven numbered teeth on the second ratchet permits the second ratchet pawl to stay engaged with the teeth when closing the door under load.

It is therefore a principal object of the invention to provide an improved anti-spin/anti-drift module for use with a "plug-in" or "plug-type" railcar door.

A further object of the invention is to provide an anti-spin/anti-drift module for a railcar door operating mechanism which prevents undesirable rotation of the operating handle when closing the door under load.

A further object of the invention is to provide an anti-spin/anti-drift module for a railcar door operating mechanism which includes first and second ratchets with the first ratchet having an even number of ratchet teeth and the second ratchet having an uneven number of teeth.

These and other objects will be apparent to those skilled in the art.

DESCRIPTION OF THE PREFERRED EMBODIMENT

Figure 1:
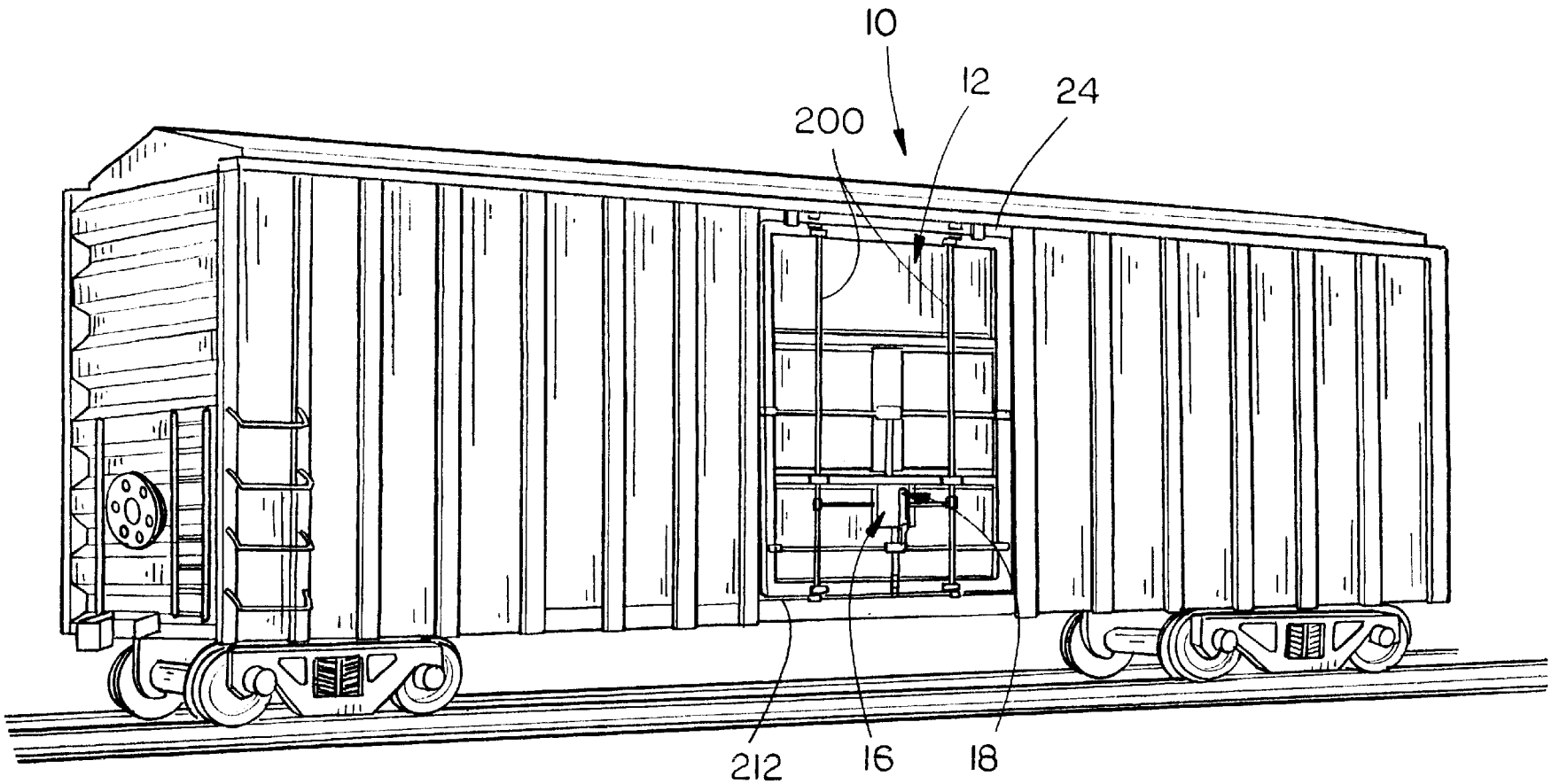
FIG. 1 is a side view of a railcar having a plug-in or plug-type door mounted therein.

Referring now to the drawings, and in particular initially to FIGS. 1–5, a railway car 10, configured with a plug-in or plug-type door 12 having an interior locking gear mechanism 14 (hereinafter referred to as "locking mechanism"), is normally covered by an access plate 16 and is normally actuated by the rotation of a handle 18 affixed to an outwardly extending shaft which normally has a pinion gear affixed to the inner end thereof which is in engagement with the teeth on the periphery of the gear segment of the mechanism 14.

Figure 2A:
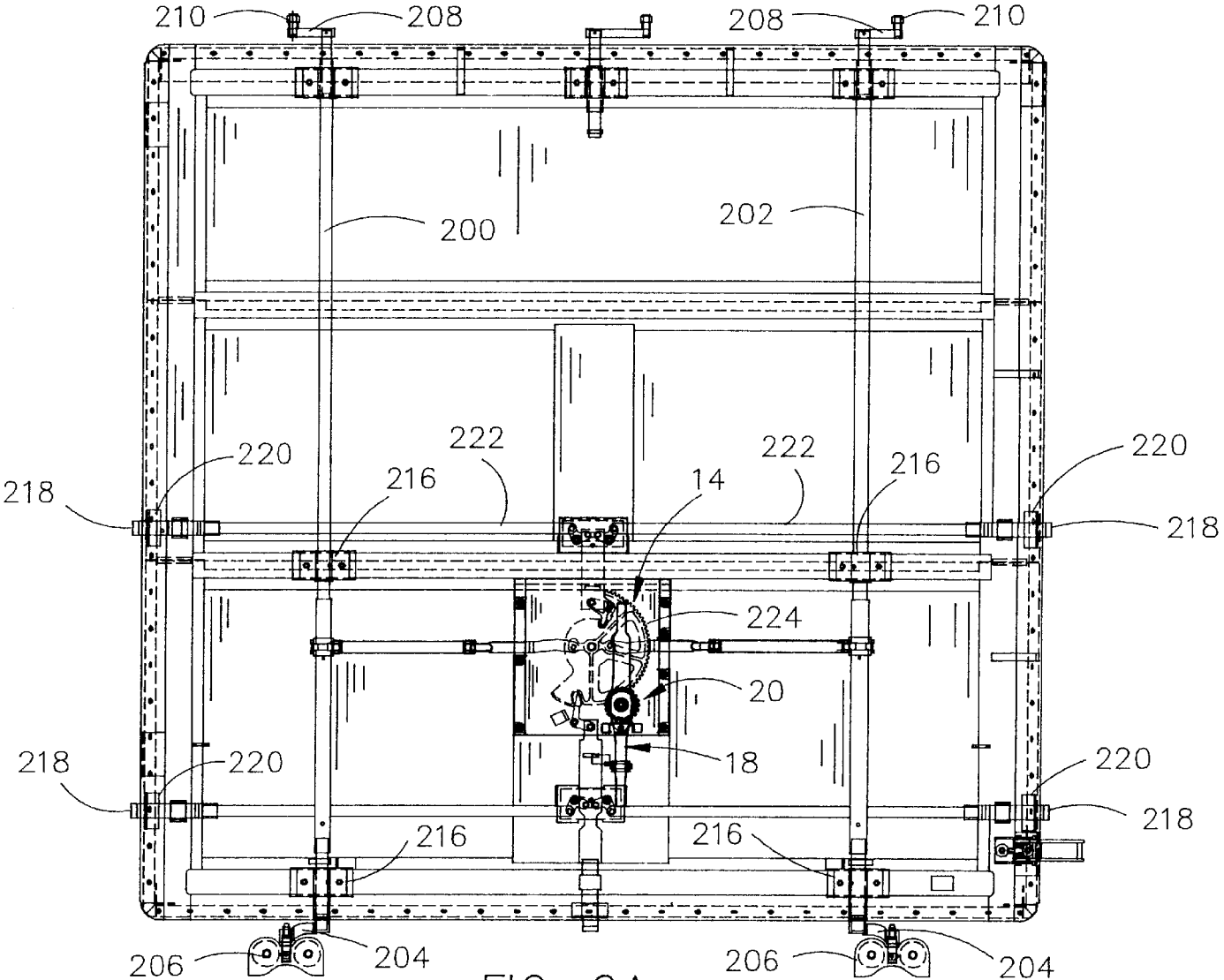
FIG. 2A is a side elevational view of the door of FIG. 1 with the module of this invention mounted therein.
Figure 2B:
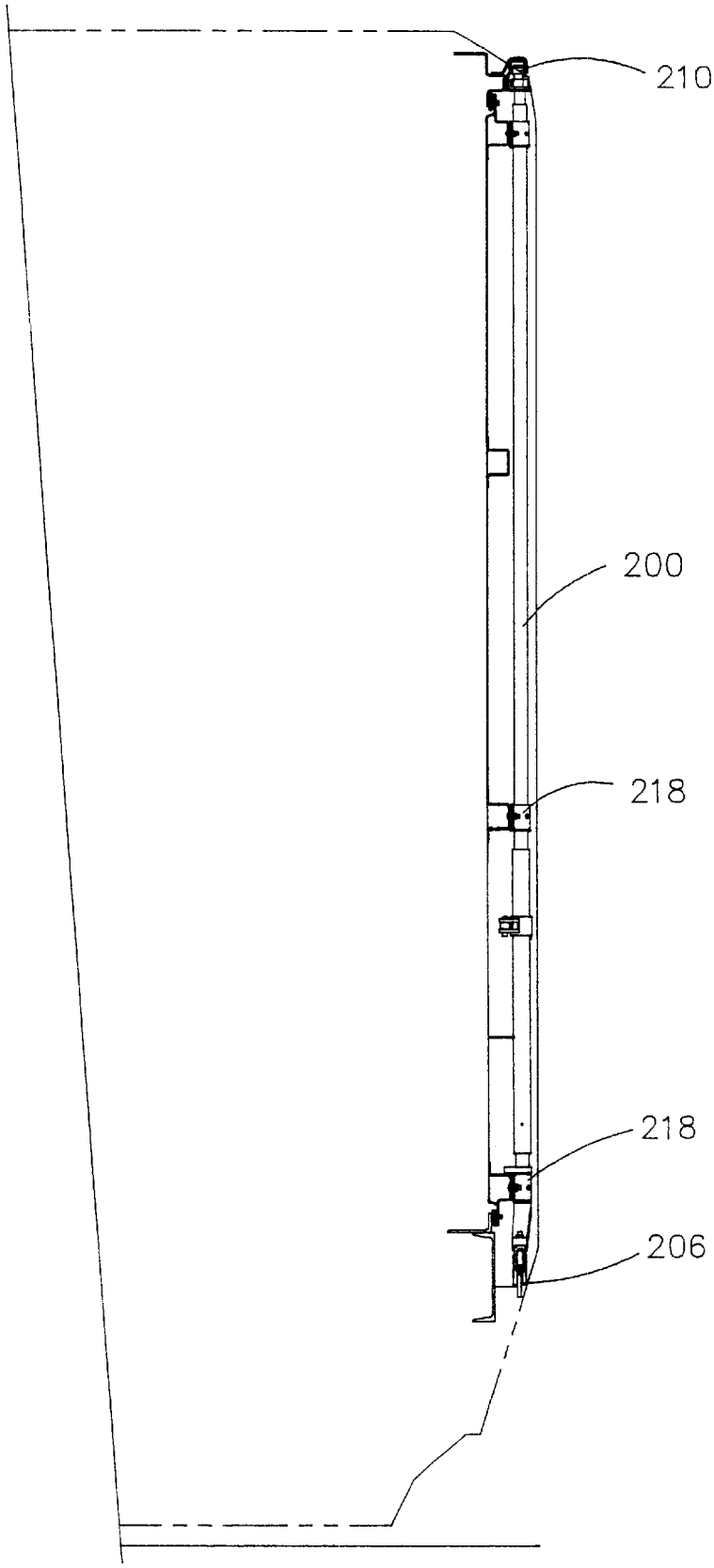
FIG. 2B is a partial end view illustrating the mechanism for opening and closing the door.
Figure 3:
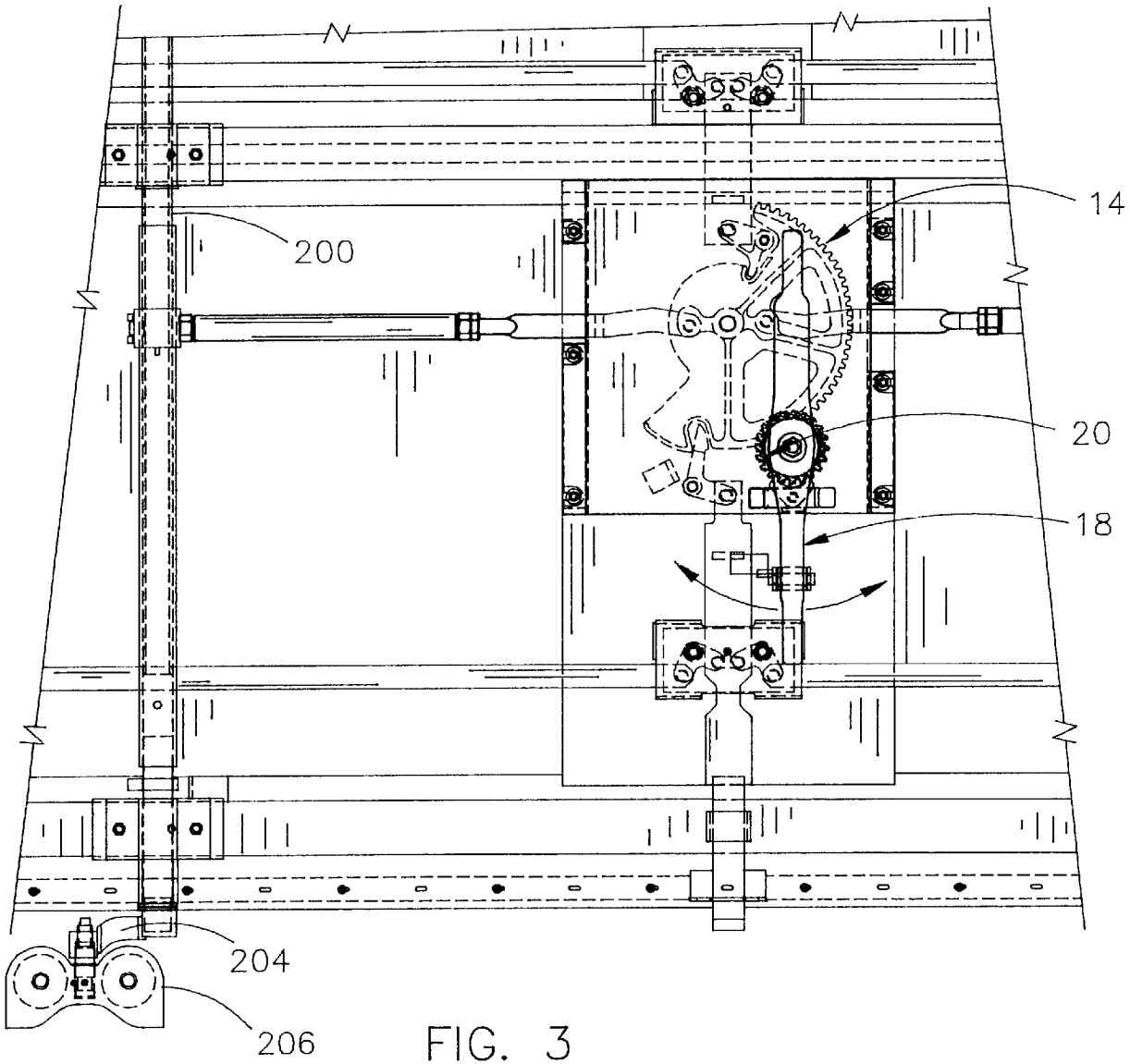
FIG. 3 is a side elevational view of the anti-spin/anti-drift module of this invention utilized with the operating mechanism for the door.
Figure 4:
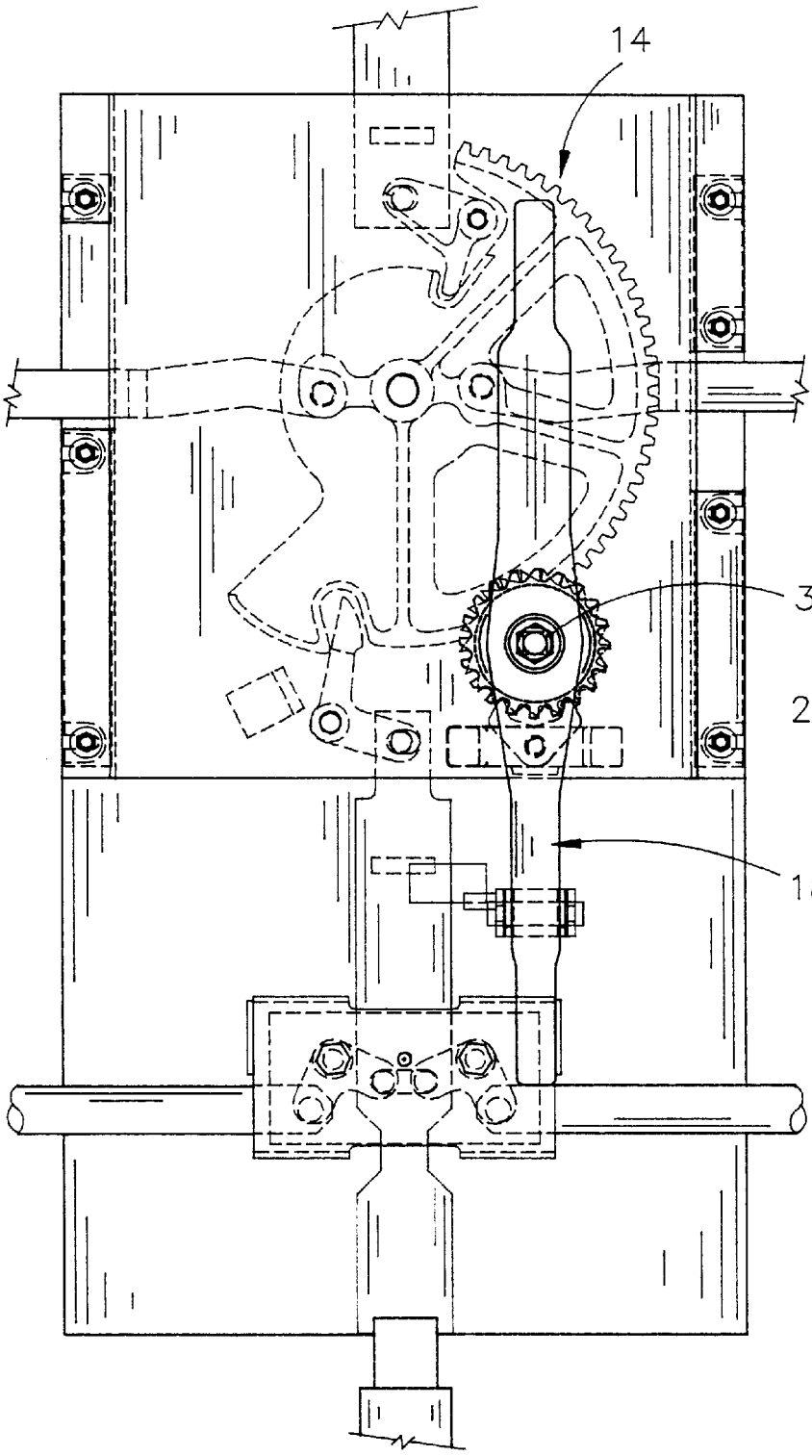
FIG. 4 is a side elevational view of the operating mechanism for the door with the module of this invention being associated therewith.
Figure 5:
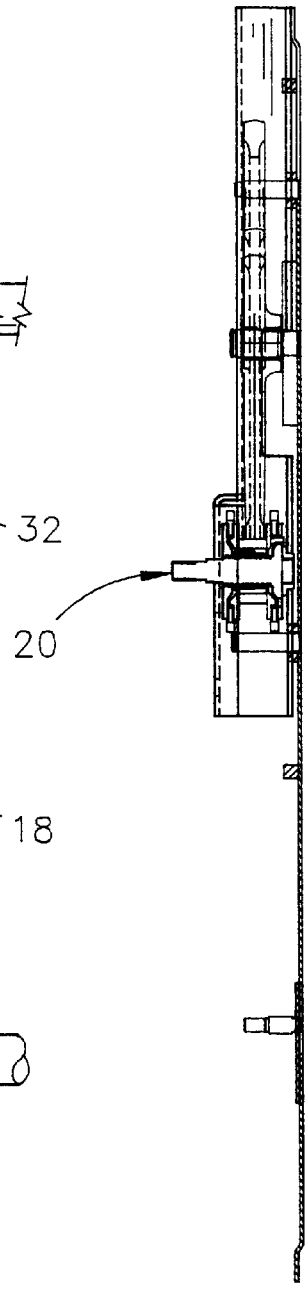
FIG. 5 is an end view of FIG. 4.

The details of the general structure of the railway car 10 and the general structural details of door 12 form no particular part of the invention; however, the door 12 is mounted so that it can move laterally into and out of the opening formed in the car 10 and be shifted longitudinally of the car 10. As seen in FIG. 2A, the door 12 is carried by a pair of vertically extending pipes or shafts 200, 202. The lower ends of the shafts 200, 202 are each provided with a laterally extending lever arm or crank 204. At the end of each of the cranks 204, a roller hanger assembly 206 is mounted for pivoting movement about a vertical axis. At the upper ends of the shafts 200, 202, arms 208 are connected to extend laterally outward in the manner shown. The outer ends of each of the arms 208 are provided with a roller 210 which extends vertically upward for rotation about a vertical axis. The roller hanger assemblies 206 are carried on a conventional track section 212 which extends longitudinally of the car and supports the door for movement therealong. The upper guide rollers 210 are received in a guideway 214 of conventional construction which also extends along the car.

Rotation of the pipes 200, 202 in the clockwise and counterclockwise directions, respectively, causes the door 12 to be swung outwardly away from the car 10, whereas, rotation in the opposite direction moves the door into engagement with the opening in the car 10. Preferably, the door carries a compression gasket seal of conventional design (not shown) about its peripheral edge so that when the door is moved into a closed position, the gasket mates with inwardly extending flanges on the door opening to seal the door.

Referring to FIG. 2A, the vertically extending shafts 200, 202 are pivotally or rotatably connected to the front face of the door 12 by suitable brackets which are bolted or otherwise connected to the door 12 in conventional fashion. Conventional means is also provided for locking the door in the closed position. Said means takes the form of a plurality of horizontally movable lock bolt members 218. As shown, each of the lock bolt members 218 is carried by a pair of slide brackets 220 which are connected to the door frame members. The upper pair of lock bolt members 218 are driven by horizontally extending drive bars 222. Thus, with the door moved into position in the opening in the car 10, outward actuation of the lock bolts 218 causes their outer ends to engage with the keeper plates to firmly lock the door into position.

As seen in the drawings, the vertical shafts 200, 202 and the horizontally extending lock bolts 218 are all commonly driven by the locking mechanism 14 in conventional fashion except for the module 20. The locking mechanism 14 functions to actuate the horizontally extending drive bars 222 in conventional fashion through the sector gear 224. Module 20 functions as a drive means for actuating the sector gear 224. As explained in U.S. Pat. No. 3,660,938, the various drive components of the conventional car door are preferably arranged so that there is a minimum of friction to make the door opening and closing relatively easy. This can cause problems in that during actuation of the door to the open position, the forces produced by the gasket and the forces produced by the contents of the car can act against the door to drive it open rapidly and cause spinning of the manual actuating handle. Similarly, when the doors are in the open position, the easy in and out movement of the door can allow it to drift and scrape and bang against the car side during movement of the car. The banging can scar the door and the side of the car requiring frequent painting and replacement of damaged parts. The subject invention provides an arrangement whereby the drive mechanism for the door opening and closing can be frictionally locked in both a closed and an open position. Further, overrunning or spinning during an operation is prevented. Likewise, drifting of the car door is also prevented by the module 20.

The accessory anti-spin/anti-drift module 20 of the present invention comprises a pinion shaft 22 having an inner end 24 and an outer end 26. The outer end 26 of pinion shaft 22 is externally threaded at 28 and has a square shaft portion 30 positioned inwardly of the externally threaded portion 28. The outer end of pinion shaft 22 extends outwardly through the cover 16 and has the operating handle 18 mounted on the square shaft portion 30. A nut 32 is threadably mounted on the externally threaded portion 28 to maintain the operating handle 18 on the square shaft portion 30.

Figure 9:
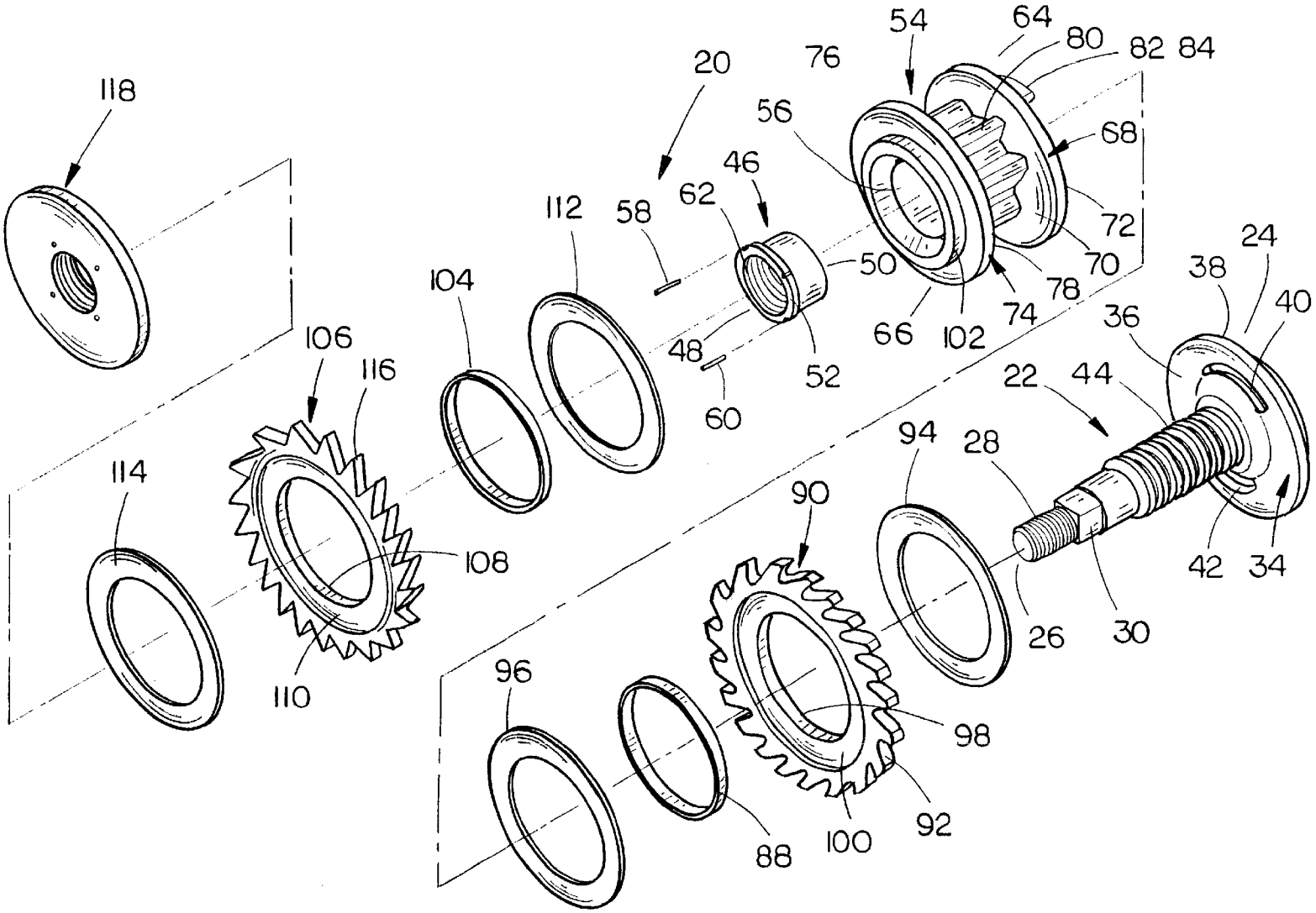
FIG. 9 is an exploded perspective view of the module of this invention.
Figure 11:
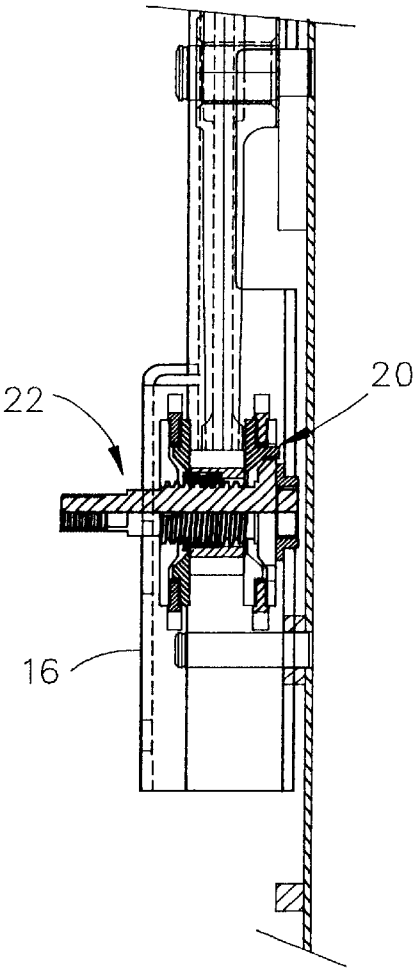
FIG. 11 is an end view of the mechanism of FIG. 10.
Figure 10:
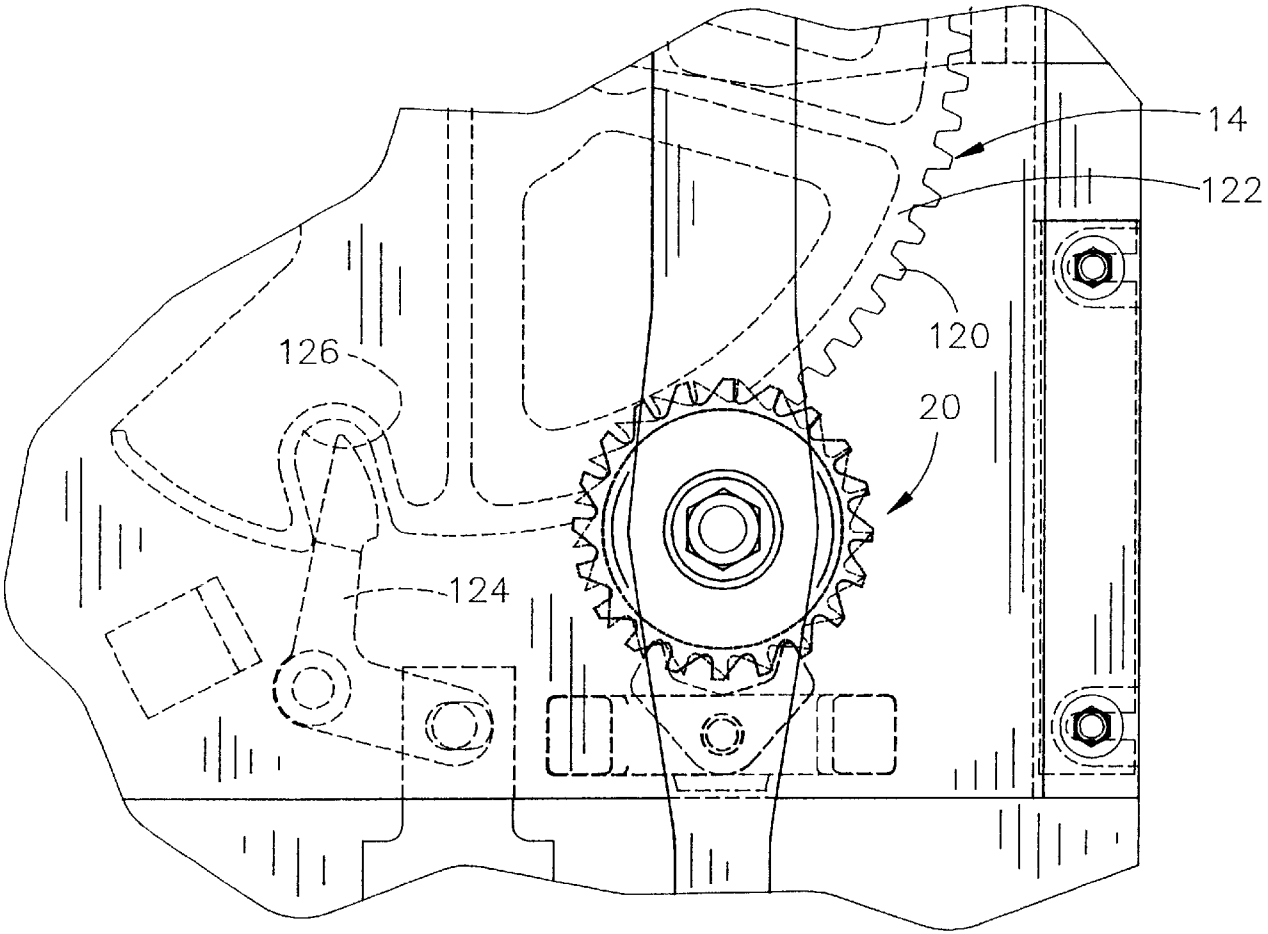
FIG. 10 is a partial side elevational view illustrating the engagement of the ratchet pawls with the teeth of the ratchets.
Figure 12:
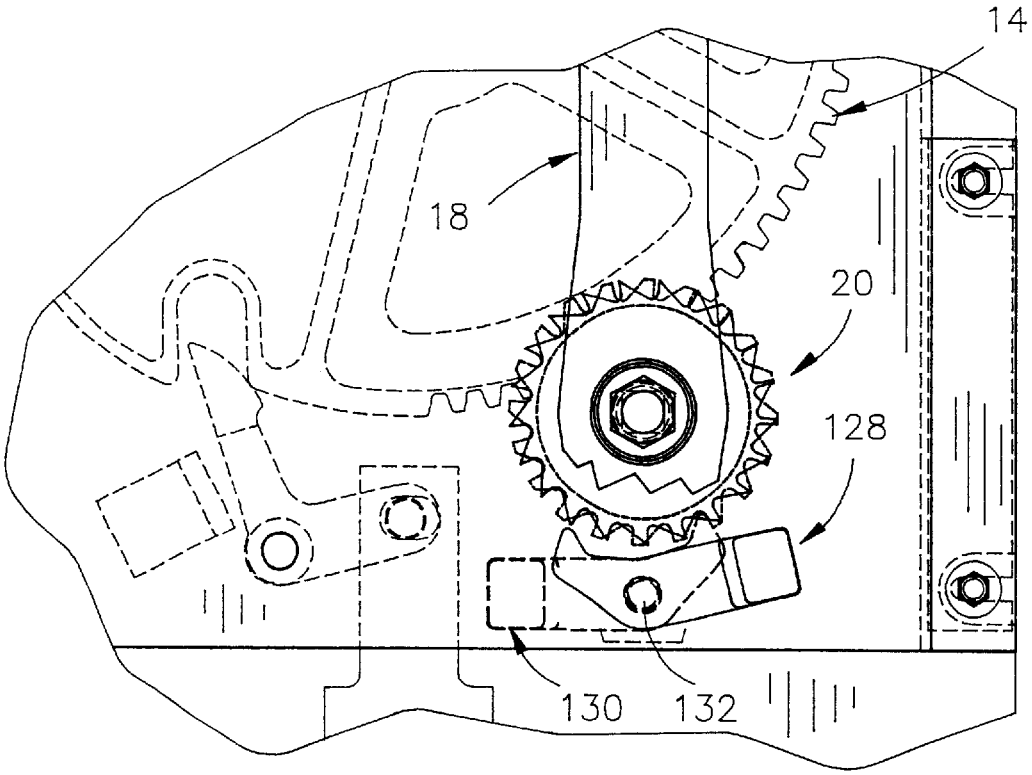
FIG. 12 is a view similar to FIG. 10 except that one of the ratchets pawls is engaging one of the ratchets.
Figure 13:
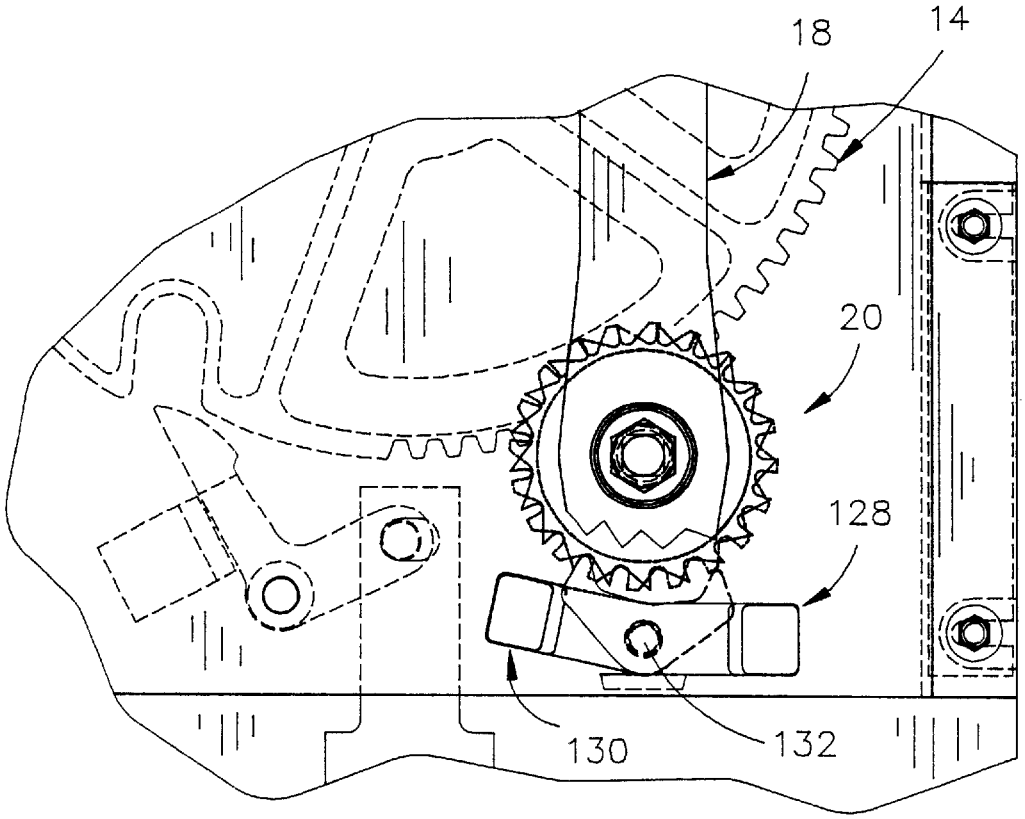
FIG. 13 is a view similar to FIG. 2 except that the other ratchet pawl is illustrated as being in engagement with the other ratchet.

A back plate 34 is secured to the inner end of the pinion shaft 22 and includes an outer surface 36 and an inner surface 38. Back plate 34 is provided with at least a pair of spaced-apart arcuate slots 40 and 42 formed therein. As seen in FIG. 9, pinion shaft 22 is provided with an externally threaded portion 44 formed thereon outwardly of the back plate 34. A pinion shaft sleeve 46 having an inner end 48 and an outer end 50 is threadably mounted on the externally threaded portion 44 of pinion shaft 22. As seen in FIG. 9, the inner end of pinion shaft sleeve 46 is provided with an annular flange 52.

Pinion gear assembly 54 is shown in FIG. 9 and includes a central opening 56 formed therein which receives the pinion shaft sleeve 46 for rotation therewith. Pins 58 and 60 pin the pinion shaft sleeve 46 to the pinion gear assembly 54 so that sleeve 46 rotates with pinion gear assembly 54. Sleeve 46 is provided with an internally threaded portion 62 which is threadably mounted on the externally threaded portion 44 of pinion shaft 22.

Figure 8:
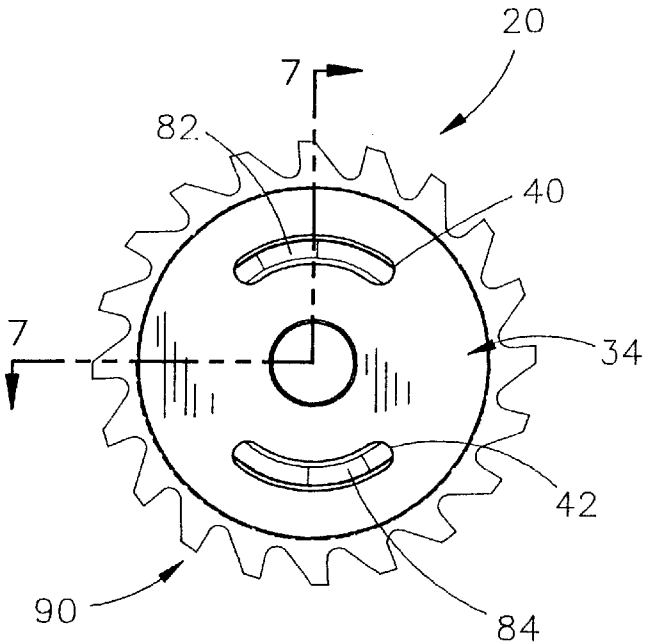
FIG. 8 is end view of the module as seen from the right of FIG. 7.

For purposes of description, pinion gear assembly 54 will be described as including an inner end 64 and an outer end 66. The pinion gear assembly 54 includes an inner ring-shaped plate 68 having an outer surface 70 and an inner surface 72. The pinion gear assembly 54 also has an outer ring-shaped plate 74 at its outer end which has an outer surface 76 and an inner surface 78. Pinion gear assembly 54 includes an externally presented pinion gear 80 which is positioned between the plates 68 and 74, as seen in FIG. 9. Pinion gear 80 is in engagement with the teeth of the locking mechanism 14 as will be described hereinafter. Inner plate 74 has a pair of arcuate dogs 82 and 84 extending inwardly therefrom which are received by the slots 40 and 42, respectively. As seen in FIG. 8, the arcuate length of the dogs 82 and 84 is less than the arcuate length of the slots 40 and 42 to permit a certain amount of relative motion between the pinion gear assembly 54 and the pinion shaft 22, as will be described hereinafter and which is fully disclosed in U.S. Pat. No. 4,920,894.

Figure 7:
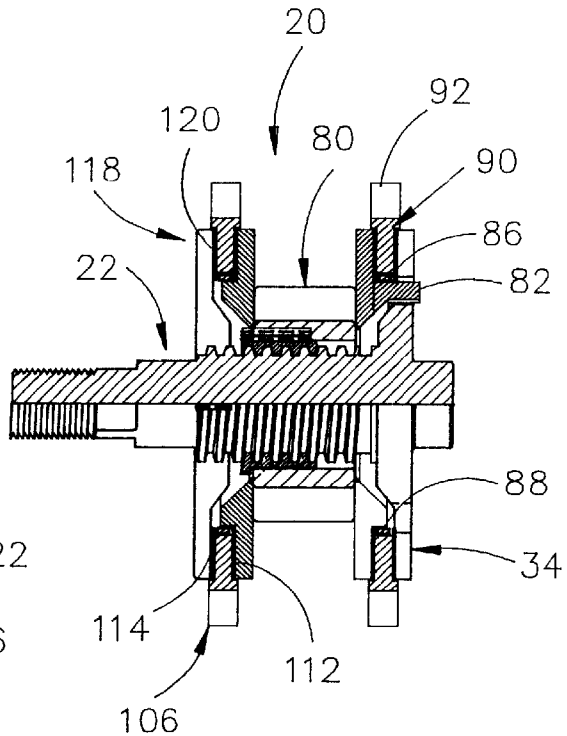
FIG. 7 is a vertical sectional view of the module of this invention as seen on lines 7—7 of FIG. 8.
Figure 6:
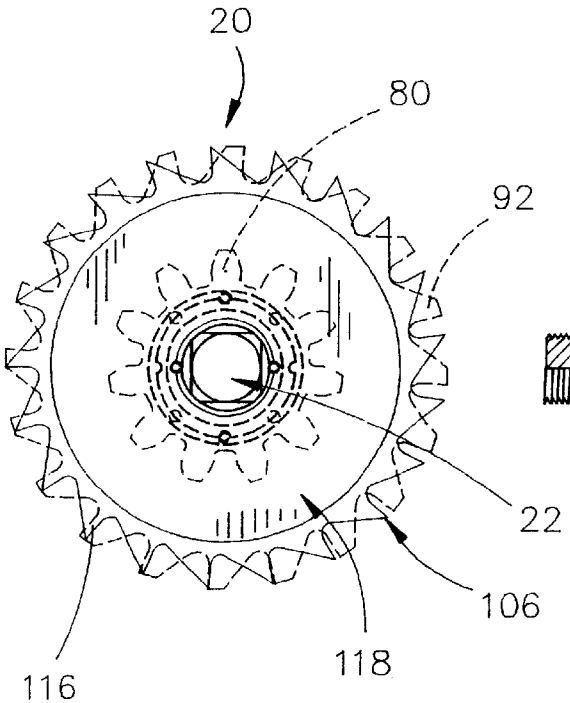
FIG. 6 is an end elevational view of the module of this invention.

Dogs 82 and 84 extend inwardly from an annular shoulder 86 formed on the inner surface of inner plate 68. A friction sleeve 88 preferably comprised of a Delrin™ 500 or Nylon™ 101 material embraces the annular shoulder 86, as seen in FIG. 7. Ratchet 90 embraces the friction sleeve 88 and is provided with a plurality of ratchet teeth 92 formed on the periphery thereof. Friction discs 94 and 96 are positioned on opposite sides of the ratchet 90 and are partially received in annular recesses 98 and 100 formed on opposite sides of the ratchet 90. As seen in FIG. 7, the ratchet 90, friction discs 94, 96 and friction sleeve 88 are positioned between the inner surface 72 of plate 68 and the outer surface 36 of back plate 34.

As seen in FIG. 9, the outer surface 76 of plate 74 on the pinion gear assembly 54 is provided with an annular shoulder 102. Friction sleeve 104, which is identical to friction sleeve 88 embraces annular shoulder 102. Ratchet 106 embraces friction sleeve 104 and has annular recesses 108 and 110 formed on opposite sides thereof which receive friction washers 112 and 114 therein, respectively. As seen in FIG. 9, ratchet 106 includes a plurality of ratchet teeth 116 on the periphery thereof. An internally threaded flange 118 is threadably mounted on the external threaded portion 44 of pinion shaft 22 outwardly of friction washer 114, as seen in the drawings. As seen in FIG. 7, the inner surface 120 of flange 118 is in engagement with friction washer 114. Threaded flange 118 is pinned to pinion shaft 22 for rotation therewith.

The module 20 of this invention is mounted in the door 12 of car 10 so that the outer end of the pinion shaft 22 extends outwardly through the access plate 16 so that handle 18 may be mounted on the square portion 30 of the pinion shaft 22. The module 20 is secured in place on the door by any convenient means such as disclosed in U.S. Pat. Nos. 3,660,938 and 4,920,894. When so installed, the pinion gear 80 is in engagement with teeth 120 of the gear 122 which is a portion of the locking mechanism 14. Locking mechanism 14 includes a cam crank 124 which is adapted to extend into the recesses 126 of the locking mechanism 14 as described in U.S. Pat. No. 3,660,938. The locking mechanism 14 is connected to the door 12 such as described in U.S. Pat. No. 3,660,938 to compressingly seal the door 12 into the car door opening as also described in U.S. Pat. No. 3,660,938.

A pair of gravity-operated ratchet pawls 128 and 130 is pivotally mounted on a pin or bolt 132 for engagement with the ratchets 90 and 106, respectively. As seen in the drawings, the teeth of the ratchets 90 and 106 are oppositely disposed and have somewhat different profiles. Further, an even number of teeth 92 are provided on the ratchet 90 with an odd number of teeth 116 being provided on the ratchet 106. The profile of each of the teeth on ratchet 106 are much sharper than the profile of each of the teeth 92 on ratchet 90. It is preferred that the number of teeth on ratchet 90 be twenty and the number of teeth on the ratchet 106 be twenty-one. With the module of this invention, it is impossible for the handle 18 to violently spin when the car door is open and the operator begins to close the same. The uneven numbered teeth on the ratchet 106 permits the ratchet pawl 130 to stay engaged with the teeth 116 when closing the door under load.

The anti-spin/anti-drift module 20 of this invention functions in an identical manner as that described in U.S. Pat. No. 3,660,938 and reliance on that disclosure is incorporated herein by reference. The main difference between the instant invention and that disclosed in U.S. Pat. No. 3,660,938 is that the ratchets 90 and 106 have different profiles with the ratchet 90 having an even number of teeth and the ratchet 106 having an uneven number of teeth so that the ratchet pawl 130 will be engaged with the teeth 116 of the ratchet 106 when the operator moves the car door from its open position towards its closed position. The design of the ratchet 106 and the uneven number of teeth provided thereon ensures that the ratchet pawl 130 will not be on top of a ratchet tooth when the operator begins to close the car door.

The operation of the drive assembly module 20 can best be understood by an explanation of a complete opening and closing cycle of operation. When the door 12 is in the closed position, to initial an opening operation, the operating handle 18 is rotated in the counterclockwise direction. Counterclockwise rotation of the pinion shaft 22 by the handle 18 causes the pinion gear assembly 54 to be moved to the right (FIG. 7) until it engages the plate 68 of ratchet 90. Continued rotation causes the plate 68 to be firmly driven into engagement with the ratchet 90 to clamp the ratchet 90 against the back plate 34. The rotation of back plate 34 with respect to pinion gear 80 is limited by the dogs 82, 84 in the slots 40, 42 as described in U.S. Pat. No. 4,920,894. At this time, the ratchet pawl 128 prevents clockwise movement of the ratchet 90, but ratchet 106 may fully rotate with respect to pinion shaft 22.

Clockwise rotation of the pinion shaft 22 by the handle 18 causes the pinion gear assembly 54 to be moved to the left (FIG. 7) until plate 74 engages the ratchet 106. Continued rotation causes the plate 74 to be firmly driven into engagement with the ratchet 106 to clamp the ratchet 106 against the threaded flange 118. At this time, the ratchet pawl 130 prevents counterclockwise movement of the ratchet 106. The ratchet pawl 130 is maintained in engagement with ratchet 106, however, the ratchet 90 can fully rotate relative to pinion shaft 22 since it is not clamped by the pinion gear assembly.

Thus it can be seen that the invention accomplishes at least all of its stated objectives.

We claim:

1. An anti-spin/anti-drift module for attached to a railway car plug-in door locking mechanism releasably locking said door, comprising:

a pinion shaft having inner and outer ends;

said outer end of said pinion shaft extending through the outer surface of said door;

an operating handle attachable to said outer end of said pinion shaft;

a back plate secured to said inner end of said pinion shaft and having inner and outer surfaces;

said back plate having at least a pair of spaced-apart arcuate slots formed therein;

said pinion shaft having an externally threaded portion thereon outwardly of said back plate;

a pinion shaft sleeve, having inner and outer ends, threadably mounted on said externally threaded portion of said pinion shaft;

a pinion gear assembly, having inner and outer ends, mounted on said pinion shaft sleeve for rotation therewith;

said pinion gear assembly having an outer ring-shaped plate at its outer end which has a inner and outer surfaces;

said pinion gear assembly having an inner ring-shaped plate at its inner end which has inner and outer surfaces;

said pinion gear assembly including an externally presented pinion gear positioned between said inner and outer plates;

said pinion gear assembly including inwardly extending dogs which are movably received by said arcuate slots in said back plate;

a first ring-shaped ratchet, having inner and outer surfaces, rotatably positioned between said inner ring-shaped plate and said back plate;

said first ring-shaped ratchet including spaced-apart peripheral ratchet teeth;

a first ring-shaped friction washer positioned between said inner surface of said inner ring-shaped plate and said outer surface of said first ratchet;

a second ring-shaped friction washer positioned between said inner surface of said first ratchet and said outer surface of said back plate;

a second ring-shaped ratchet having inner and outer surfaces rotatably positioned adjacent said outer surface of said outer ring-shaped plate;

said second ratchet including spaced-apart peripheral ratchet teeth;

a third ring-shaped friction washer, having inner and outer surfaces, positioned between said outer surface of said outer ring-shaped plate and said inner surface of said second ratchet;

a flange mounted on said pinion shaft outwardly of said second ratchet for rotation with said pinion shaft and having inner and outer surfaces;

a fourth ring-shaped friction washer positioned between said outer surface of said second ratchet and said inner surface of said flange;

said ratchet teeth of said first and second ratchets facing opposite directions;

said ratchet teeth of said first ratchet adapted to be engaged by a first ratchet pawl;

said ratchet teeth of said second ratchet adapted to be engaged by a second ratchet pawl;

said first ratchet having an even number of ratchet teeth;

said second ratchet having an odd number of ratchet teeth.

2. The invention as defined in claim 1 wherein the ratchet teeth of said first and second ratchets have different profiles.

3. The invention as defined in claim 2 wherein the ratchet teeth of said second ratchet are pointed and wherein the ratchet teeth of said first ratchet are blunt.

4. An anti-spin/anti-drift module for attached to a railway car plug-in door locking mechanism releasably locking said door, comprising:

a pinion shaft having inner and outer ends;

said outer end of said pinion shaft extending through the outer surface of said door;

an operating handle attachable to said outer end of said pinion shaft;

a back plate secured to said inner end of said pinion shaft and having inner and outer surfaces;

said pinion shaft having an externally threaded portion thereon outwardly of said back plate;

a pinion gear assembly, having inner and outer ends, threadably mounted on said externally threaded portion of said pinion shaft;

a first ring-shaped ratchet rotatably positioned on said pinion shaft between said inner end of said pinion gear assembly and said back plate;

said first ring-shaped ratchet including spaced-apart peripheral ratchet teeth;

a first ring-shaped friction washer positioned between said first ring-shaped ratchet and said back plate;

a second ring-shaped friction washer positioned between said first ring-shaped ratchet and said inner end of said pinion gear assembly;

a second ring-shaped ratchet rotatably positioned on said pinion shaft at said outer end of said pinion gear assembly;

said second ring-shaped ratchet including spaced-apart peripheral ratchet teeth;

a third ring-shaped friction washer positioned between said second ring-shaped ratchet and said pinion gear assembly;

a flange threadably mounted on said pinion shaft outwardly of said second ring-shaped ratchet;

a fourth ring-shaped friction washer positioned between said second ring-shaped ratchet and said flange;

said flange being operatively secured to said pinion gear assembly for rotation therewith relative to said pinion shaft;

the rotation of said pinion shaft in a first direction by said operating handle causing said pinion shaft to threadably move with respect to said pinion gear assembly thereby frictionally clamping said first ring-shaped ratchet between said inner end of said pinion gear assembly and said back plate through said first and second friction washers;

the rotation of said pinion shaft in a second direction opposite to said first direction by said operating handle causing said pinion shaft to threadably move with respect to said pinion gear assembly thereby frictionally clamping said second ring-shaped ratchet between said outer end of said pinion gear assembly and said threaded flange through said third and fourth friction washers;

said first ring-shaped ratchet having an even number of ratchet teeth;

said second ring-shaped ratchet having an odd number of ratchet teeth;

a first ratchet pawl associated with said first ring-shaped ratchet for preventing rotation of said first ring-shaped ratchet in one direction;

a second ratchet pawl associated with said second ring-shaped ratchet for preventing rotation of said second ring-shaped ratchet in one direction;

said ratchet teeth of said first ring-shaped ratchet being opposed to the ratchet teeth of said second ring-shaped ratchet.

5. The module of claim 4 wherein said back plate has at least two arcuate slots formed therein and wherein said pinion gear assembly has at least a pair of dogs extending therefrom which are received by said slots.

6. The module of claim 4 wherein said ratchet teeth of said first ring-shaped ratchet have a different profile than said ratchet teeth of said second ring-shaped ratchet.

* * * * *